US005933881A

United States Patent [19]

Smith

[11] Patent Number: 5,933,881

[45] Date of Patent: Aug. 10, 1999

[54] BIDET DEVICE

[76] Inventor: Warren Smith, 895 Adams Blvd., Boulder City, Nev. 89005

[21] Appl. No.: 08/889,931

[22] Filed: Jul. 10, 1997

[51] Int. Cl.[6] ..... A47K 3/20

[52] U.S. Cl. ..... 4/420.4

[58] Field of Search ..... 4/420.2, 420.4, 4/444, 447

[56] References Cited

U.S. PATENT DOCUMENTS

| | | | |
|---|---|---|---|
| 312,373 | 2/1885 | Mott, Jr. . | |
| 2,094,170 | 9/1937 | Heald | 4/420.2 |
| 2,504,257 | 4/1950 | Dunn . | |
| 2,605,477 | 8/1952 | Monserrat . | |
| 2,753,570 | 7/1956 | Evans . | |
| 4,197,594 | 4/1980 | Butterfield . | |
| 4,205,402 | 6/1980 | Miller . | |
| 4,383,339 | 5/1983 | Miller . | |
| 4,696,673 | 9/1987 | Ledin-Bonevik . | |
| 4,807,311 | 2/1989 | Ingels . | |
| 4,953,238 | 9/1990 | Shifferly | 4/420.4 X |
| 4,998,300 | 3/1991 | Sharifzadeh | 4/420.4 |
| 5,063,618 | 11/1991 | Souka . | |
| 5,210,885 | 5/1993 | Ruo | 4/420.2 X |
| 5,384,919 | 1/1995 | Smith . | |
| 5,572,748 | 11/1996 | Nee | 4/420.2 |

FOREIGN PATENT DOCUMENTS

| | | | |
|---|---|---|---|
| 2410717 | 9/1974 | Germany | 4/420.4 |

OTHER PUBLICATIONS

Internet Webpage, USA Bidet.

Internet Webpage, Sani Bidet.

Internet Webpage, Geberit Shower Toilet.

Internet Webpage, Toto Device.

*Primary Examiner*—Charles E. Phillips
*Attorney, Agent, or Firm*—Quirk & Tratos

[57] ABSTRACT

A rotatable handle and a valve block are carried on a frame that is mounted on the exterior of a toilet bowl. A transfer tube of a rotatable insert in the valve block couples the handle to the valve block. The handle has an outlet hole wherein a proximal end of a water tube is disposed. The water tube extends from the exterior to the interior of the bowl via a space between the toilet seat and the rim of the bowl. A distal portion of the water tube extends over water within the bowl. The distal portion has a plurality of aligned holes therein. The handle is urged to a rest position by a spring. When the handle is at the rest position, a passageway of the valve block is occluded by a valve stem, thereby preventing a flow of water to the water tube. In response to the handle being rotated from the rest position, the passageway is cleared and the flow of water is provided which results in a sheet of water being discharged from the aligned holes. The sheet of water is directed towards the underside of a woman seated upon the toilet seat.

15 Claims, 5 Drawing Sheets

BIDET DEVICE

BACKGROUND OF THE INVENTION

1. Field of Invention

This invention relates generally to cleansing parts of a person's body and, more specifically, to cleansing genital, anal and perineal skin areas of a person.

2. Description of the Prior Art

The bidet is a well known apparatus for cleansing the underside of a person's torso. The bidet is comprised of a basin wherein a nozzle provides an upward fountain of water. The person positions themselves over the basin and turns on the water to cause the water to be directed to the underside of the torso.

Although the bidet is frequently used in Europe, its use in the United States is infrequent. However, in the prior art a device that is adapted to fit a standard toilet causes the toilet to function similarly to the bidet.

As disclosed in U. S. Pat. No. 5,384,919, for example, a user applies a lateral force to a control handle of the device against a bias of a spring. In response to the applied force, the control handle moves from a lateral rest position to control a flow of a focused stream of water from the nozzle. When the control handle is released, the spring causes a lateral movement of the control handle to the lateral rest position, thereby terminating the flow of water.

When the control handle is in a vertical rest position, the nozzle is located to permit the toilet to be used for normal toilet facility activities. In response to the control handle being rotated vertically from the vertical rest position, the nozzle moves along an arcuate path in a vertical plane whereby the nozzle is located for use. After the device is used, the person is obliged to remember to vertically rotate the handle to the vertical rest position to again permit use of the toilet for the normal toilet facility activities.

In other words, a user operates the device by performing the following separate and distinct actions:

(a) the rotation of the control handle from the vertical rest position to locate the nozzle for use;

(b) applying the lateral force to of the control handle to control the flow of the water from the nozzle;

(c) removal of the applied force; and (d) the rotation of the control handle to the vertical rest position.

It should be understood that when the user is minimally coordinated, such as a paralyzed person, a stroke victim an arthritic person or a person who has any of a plethora of other disabilities, the movement necessary to operate the device may be intolerably burdensome.

When the nozzle is located for use and the user desires to direct the stream to an area that is laterally displaced from the vertical plane, the user must move their torso laterally.

It should be appreciated that lateral movement of the torso may result in clothing being splashed. Moreover, when the person is either minimally coordinated or obese, suitable lateral movement may be impossible.

There is a need for a cleansing apparatus that fits the standard toilet, requires a single user motion for operation and minimizes the need for the lateral movement of the torso and obviates adjustment to permit the normal toilet activities.

SUMMARY OF THE INVENTION

An object of the present invention is to cleanse a person's genital, anal and perineal skin areas.

Another object of the invention is to cleanse a person's genital, anal and perineal skin areas with warm water.

Another object of the invention is to cleanse a person's genital, anal and perineal skin areas with a medicated solution.

According to a first aspect of the present invention, a rotatable handle is carried on a frame that is on the exterior of a toilet bowl of a toilet. A proximal end of a water tube is disposed within an outlet hole of the handle. A distal portion of the water tube, having a plurality of aligned holes therein, extends over water within the bowl. In response to a liquid being provided to the water tube, a sheet of the liquid is discharged from the aligned holes. The orientation of the aligned holes causes the sheet of the liquid to be directed towards the underside of the torso of a person seated on the seat of the toilet.

According to a second aspect of the present invention, when the handle is at a rest position, there is an occlusion of a supply of liquid provided to the water tube. The occlusion is cleared when the handle is rotated from the rest position.

According to a third aspect of the present invention, the handle is urged to rotate to the rest position.

The invention provides apparatus for cleansing the underside of a person's torso with either warm water or a medicated solution in response to movement of a handle. The medicated solution may be particularly desirable when it is used to cleanse, for example, the perineal region of a women who has recently had an episiotomy.

Other objects, features, and advantages of the invention should be apparent from the following description of the preferred embodiment as illustrated in the accompanying drawing.

DESCRIPTION OF THE PREFERRED EMBODIMENT

Figures 1, 2:
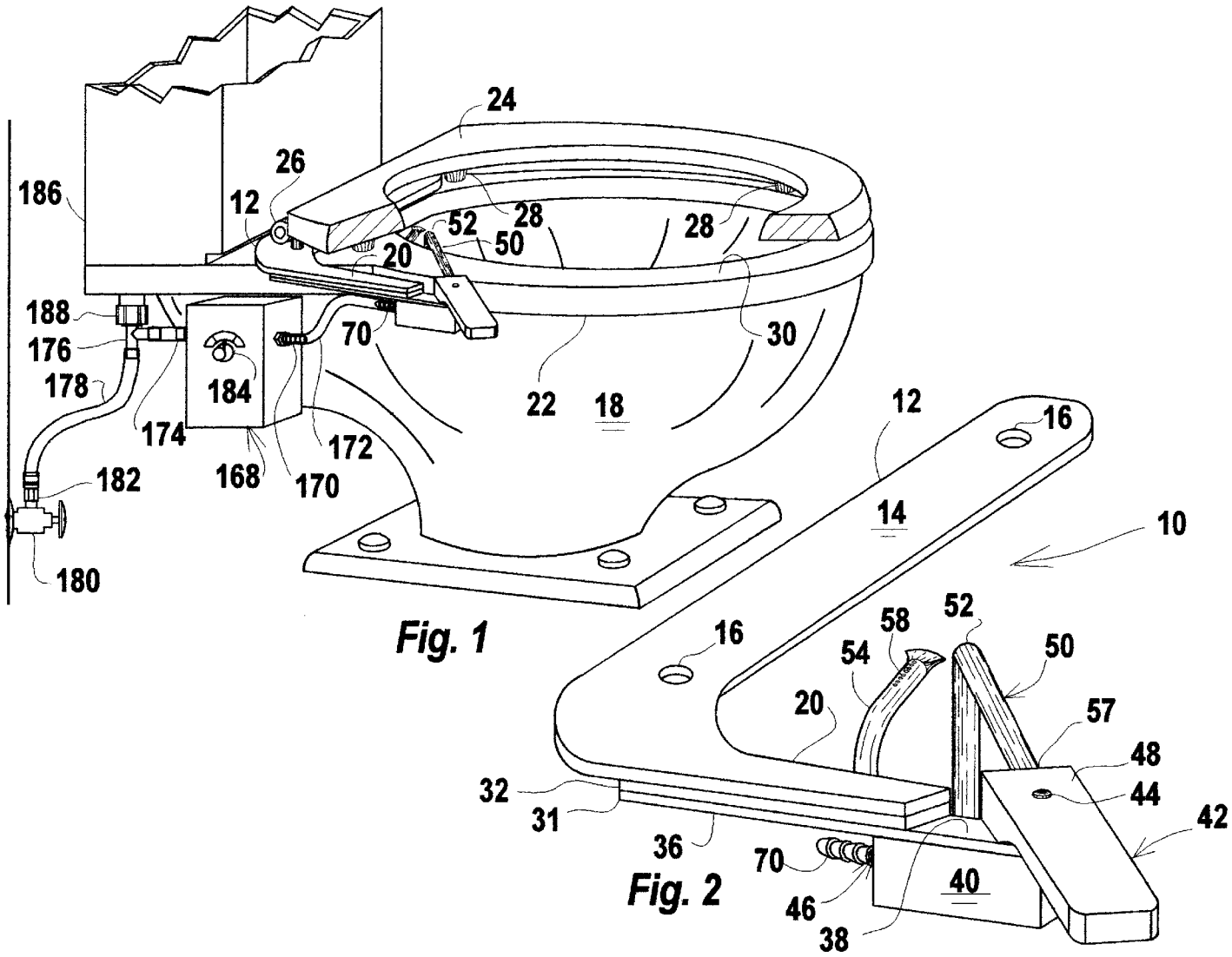
FIG. 1 is a perspective view, with a part broken away, of the preferred embodiment of the present invention.
FIG. 2 is a perspective view of apparatus in the embodiment of FIG. 1.

As shown in FIGS. 1–4, a cleansing apparatus 10 (FIG. 2) includes an L shaped toilet mounting frame 12 that is preferably made from plastic. The frame 12 has a long side 14 with a pair of mounting holes 16 that have a spacing therebetween that is substantially equal to the spacing between mounting holes of a toilet seat. The spacing between the toilet seat mounting holes is standardized in the United States.

The long side 14 is positioned upon the rear of the exterior of a toilet bowl 18 (FIG. 1) of a toilet, with the holes 16 aligned with corresponding holes (not shown) of the bowl 18. A short side 20 of the frame 12 extends on the exterior of the bowl 18 along an outer edge 22 thereof.

A toilet seat 24 includes a hinged section 26 where the toilet seat mounting holes are located. Mounting bolts (not shown) pass through the holes of the bowl 18, the holes 16 and the toilet seat mounting holes whereby the long side 14 is sandwiched between the rear of the exterior of the bowl 18 and the hinged section 26. The bolts are screwed into nuts (not shown).

A plurality of standoffs 28 are connected to the bottom of the seat 24 in any suitable manner. The standoffs 28 create a space between the seat 24 and a rim 30 of the bowl 18 that is used in a manner described hereinafter. The use of a standoff to create a space between a toilet seat and a toilet bowl is well known in the art and is commonly provided on standard toilet seats.

A plastic spacer strip 32 (FIG. 2) is cemented between the short side 20 and a plastic component strip 34. The strip 34 has a surface 36 whereon a plastic valve block 40 is carried. A plastic handle 42 is carried on a surface 38 of the strip 34. The handle 42 is rotatable upon the surface 38 about a screw 44. The valve block 40 is connected to a hose bib 46.

A proximal end 51 of a plastic water tube 50 extends from an end 48 of the handle 42. More particularly, the tube 50 extends horizontally from the end 48. Because of the strip 32, the tube 54 passes beneath the seat 24, over the rim 30 (FIG. 1) to the interior of the bowl 18 via the space created by the spacers 28.

The tube 50 has a first right angle bend 52 (FIGS. 1–3) that causes a distal portion 54 (FIG. 3) of the tube 50 to extend below the rim 30. The tube 50 additionally has a second right angle bend 56 that causes the distal portion 54 to extend over water within the bowl 18. The distal portion 54 has a plurality of longitudinally aligned holes 58 therein (FIGS. 1–4).

In response to water being provided to the proximal end 51, a sheet of water is discharged from the holes 58. The orientation of the holes 58 causes the sheet of water to be directed towards the underside of the torso of a person seated upon the seat 24.

The sheet of water has been found to cause less splashing and provide superior cleansing than a fountain of water typically produced by devices of the prior art. Additionally, a wide coverage provided by the sheet of water obviates both the lateral movement of the person and a precise targeting of the water.

Figure 4:
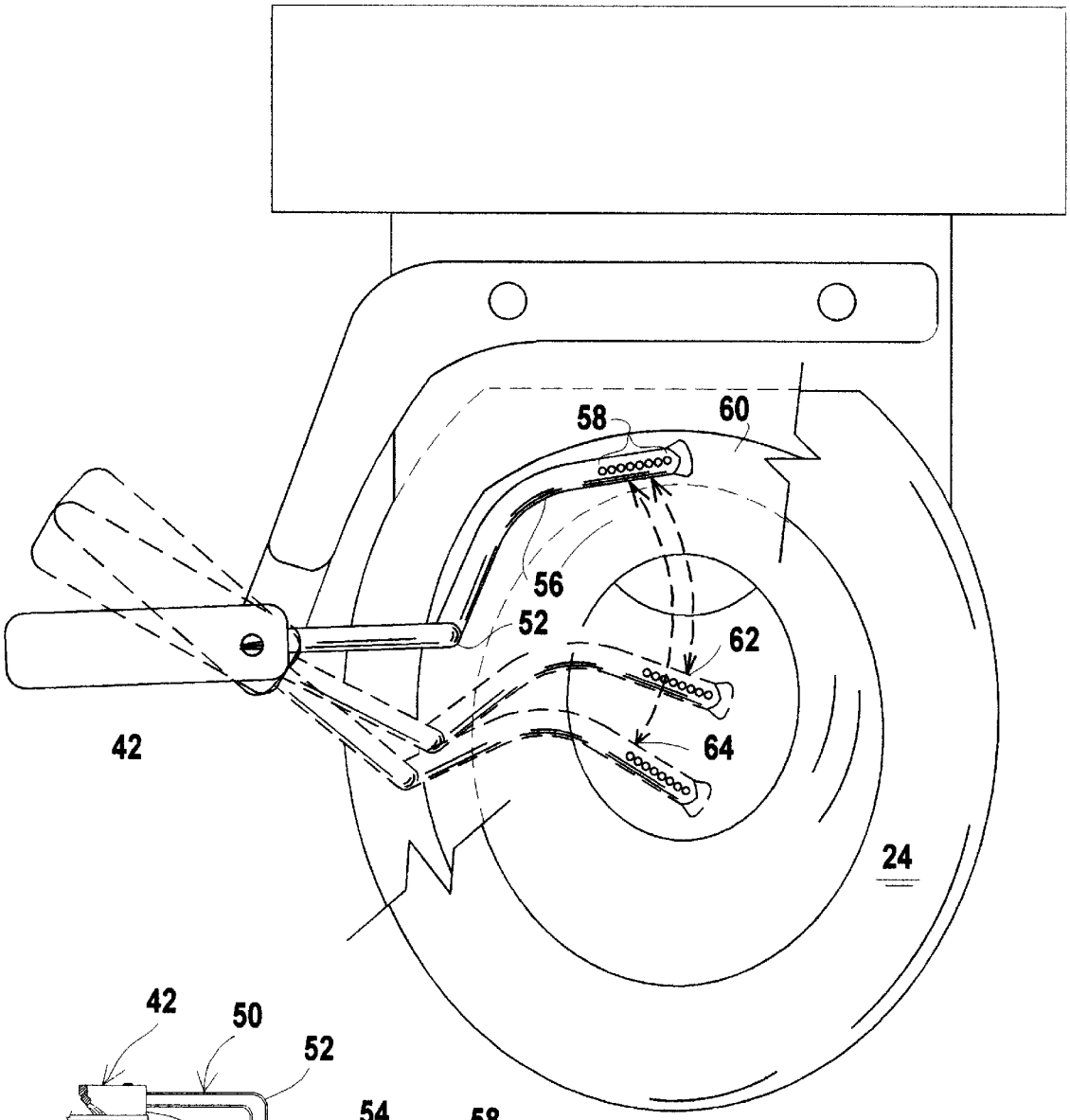
FIG. 4 is a plan view, with a part broken away, of the embodiment of FIG. 1.
Figure 3:
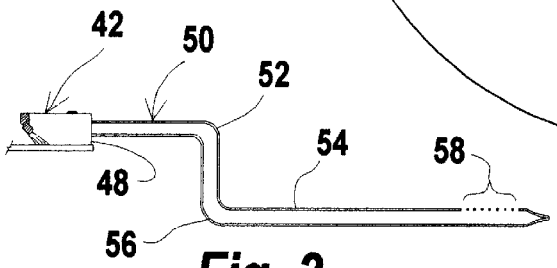
FIG. 3 is a side elevation of a water tube in the embodiment of FIG. 1.

The tube 50 is at a withdrawn location when the distal portion 54 is withdrawn to a rear portion 60 of the bowl 18 (FIG. 4). When the tube 50 is withdrawn, the toilet can be used for the usual toilet facility activities without the tube 50 be subjected either to droppings of fecal matter or urine. For reasons explained hereinafter, water is not discharged from the holes 58 when the tube 50 is withdrawn. When the tube 50 is not withdrawn, water that flows into the hose bib 46, passes through the valve block 40 and the handle 42 to the tube 50. The water is discharged from the holes 58.

When, for example, the handle 42 is rotated to cause the distal portion 54 to pivot to a location 62, the tube 50 is in an anal cleansing position, whereby the sheet of water cleanses the anus of a woman seated upon the seat 24. When the handle 42 is rotated to cause the distal portion 54 to pivot to a location 64, the tube 50 is in a vaginal cleansing position whereby the sheet of water cleanses the woman's vagina. It should be understood that the handle 42 is rotatable to cause the distal portion 54 to be at any location that is intermediate to the locations 62, 64 whereby the sheet of water is moved to cleanse the woman's perineal skin area.

Figure 5:
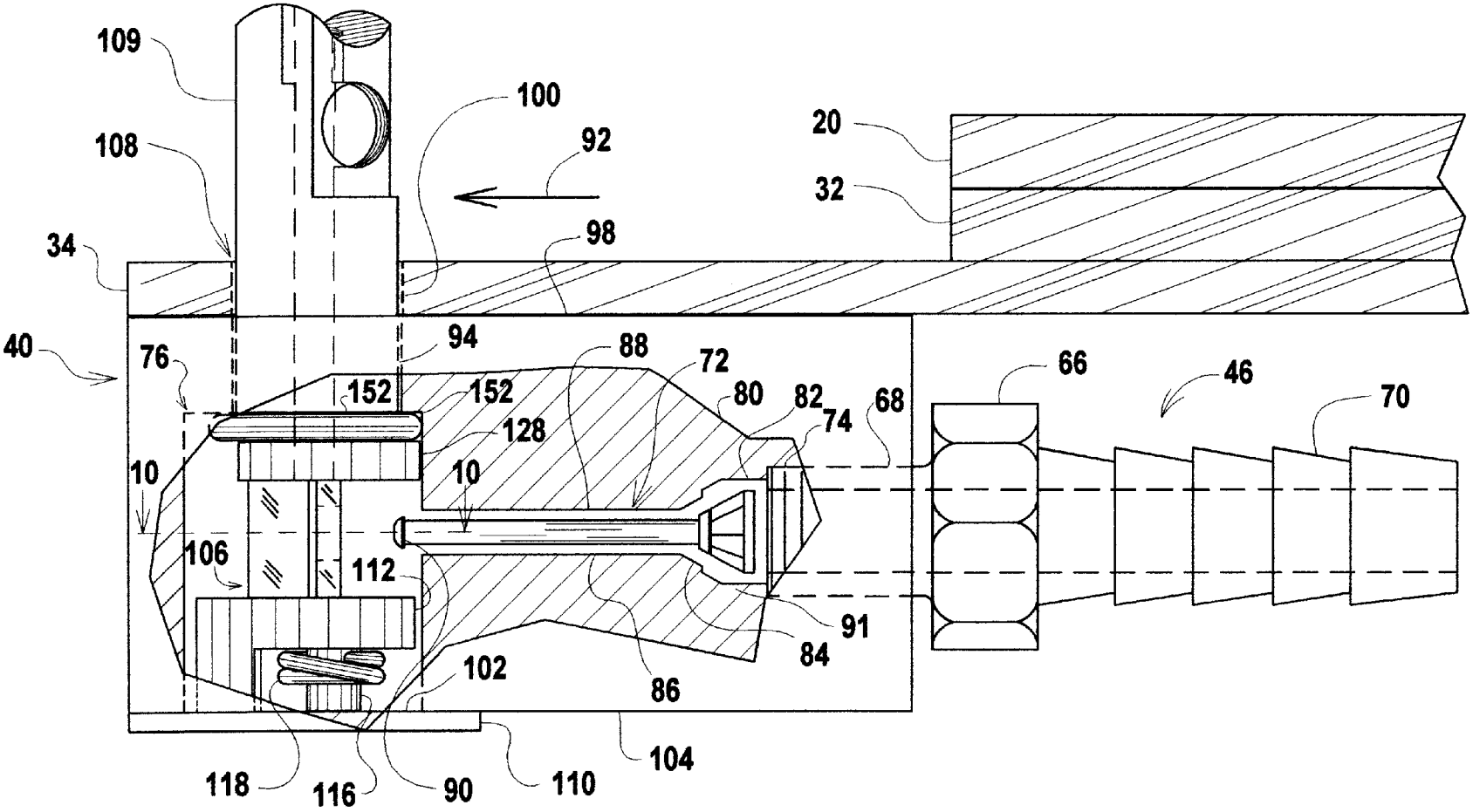
FIG. 5 is a side elevation, with parts broken away, of a valve block and a hose bib in the embodiment of FIG. 1.

As shown in FIG. 5, the hose bib 46 has a mid-section 66 in the shape of a hexagonal bolt head. The hose bib 46 additionally has a threaded end 68 and a scalloped end 70. As explained hereinafter, the end 68 is screwed into the valve block 40. Hose bibs are well known to those skilled in the art.

A passageway 72 within the valve block 40 extends from a widened threaded section 74 thereof to a valve chamber 76. The end 68 screws into the threaded section 74. A wrench (not shown) may be used to turn the mid-section 66 to screw the end 68 into the threaded section 74.

The passageway 72 includes a coupling section 80 that has the general shape of a funnel. A wide end 82 of the coupling section 80 is connected to the threaded section 74. A narrow end 84 of the coupling section 80 is connected to one end of a narrowed cylindrical section 86 of the passageway 72; the other end is contiguous with an opening in the valve chamber 76. Accordingly, there is a path for water that extends from the hose bib 46 to the valve chamber 76.

A valve stem 88 is disposed mostly within the passageway 72. The valve stem 88 has a rounded end 90. The end 90 extends into the interior of the valve chamber 76.

The valve stem 88 additionally has an end 91 that has the shape of a right truncated cone. The end 91 is disposed within the coupling section 80.

The pressure of water provided via the hose bib 46 urges the valve stem 88 to move in the direction of an arrow 92. Because of its conical shape, the end 91 occludes the passageway 72 to prevent a flow of water to the valve chamber 76. As explained hereinafter, the passageway 72 is cleared when the handle 42 is rotated to cause the tube 50 to move from the rest position.

A hole 94 extends from the valve chamber 76 to a top surface 98 of the valve block 40. The hole 94 is coaxial with a hole 100 through the strip 34. The holes 94, 100 have substantially the same diameter.

A hole 102 extends from the valve chamber 76 through a bottom surface 104 of the valve block 40. A plastic valve chamber insert 106 is inserted through the hole 102 into the valve chamber 76. The insert 106 includes a transfer tube 108 that has a section 109 that protrudes through the hole 100. The transfer tube 108 has a generally cylindrical shape. After the insertion, the hole 102 is sealed by a plastic sheet 110 that is cemented to a bottom surface 104 of the valve block 40.

Figure 6:
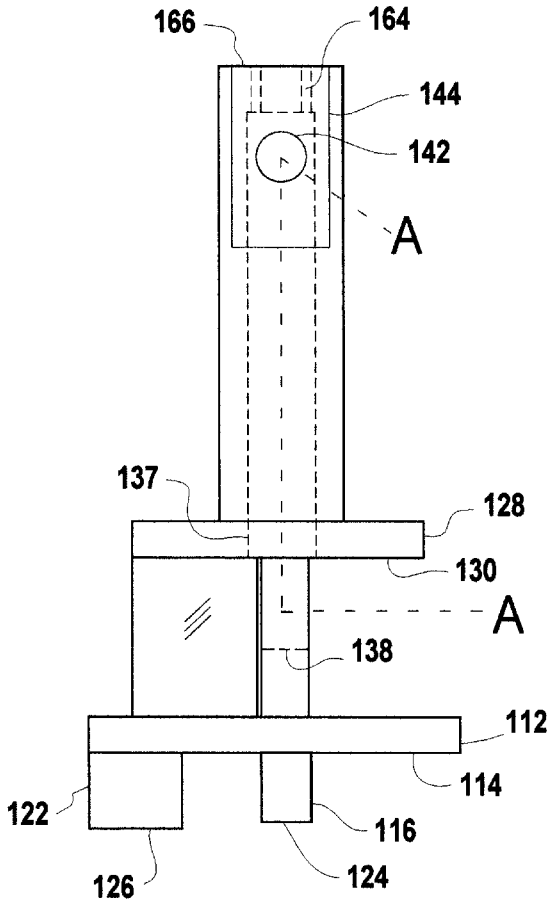
FIG. 6 is a front view of a valve chamber insert of FIG. 5.
Figure 7:
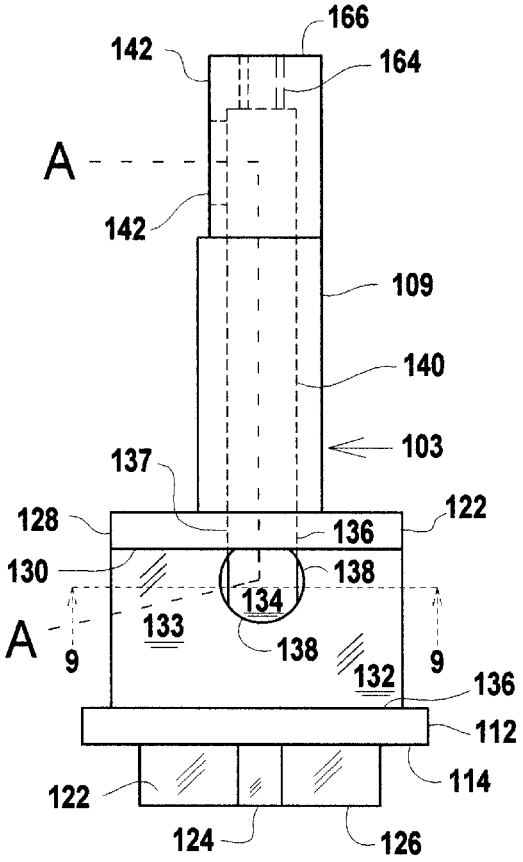
FIG. 7 is side elevation of the valve chamber insert of FIG. 6.
Figure 8:
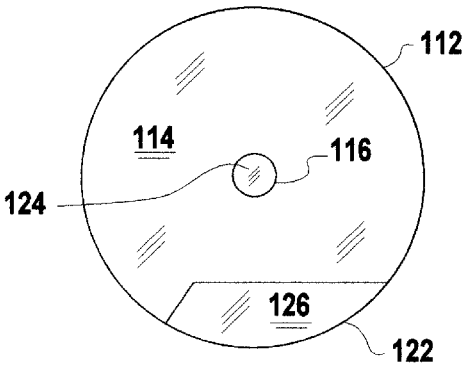
FIG. 8 is a bottom view of the valve chamber insert of FIG. 7.

As shown in FIGS. 6–8, the insert 106 includes a disc 112 with a surface 114 that is integrally connected to a cylindrical capstan 116. The disc 112 and the capstan 116 are coaxial.

A coil spring 118 (FIG. 5) is wound about the capstan 116. One end of the spring 118 (not shown) is fixedly connected to the capstan 116; the other end is fixedly connected to a the wall of the valve chamber 76. The purpose of the spring 118 is explained hereinafter.

The disc 112 is integrally connected to a support member 122 (FIGS. 6–8). A surface 124 (FIG. 8) of the capstan 116 and a surface 126 of the member 122 are rotatably supported upon the sheet 110 (FIG. 5). Accordingly, a rotary movement of the insert 106 causes a corresponding rotary sliding movement of the capstan 116 and the member 122 upon the sheet 110.

Figure 10:
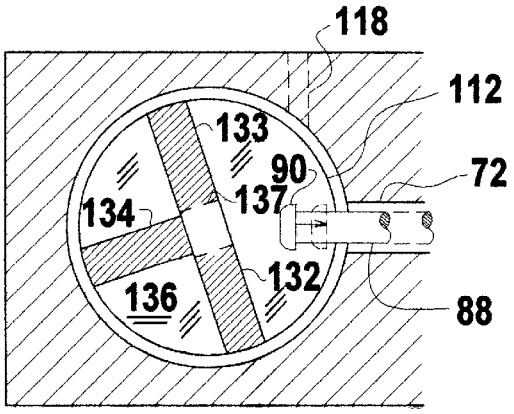
FIG. 10 is a view of the valve chamber insert of FIG. 5 taken along the line 10—10.
Figure 9:
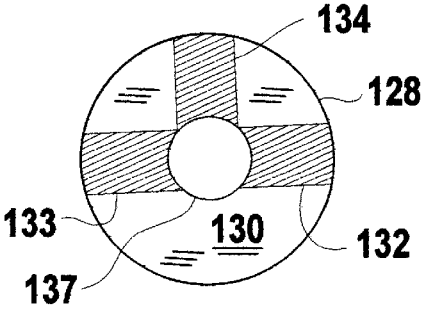
FIG. 9 is a view of the valve chamber insert of FIG. 7 taken along the line 9—9.

As shown in FIGS. 9 and 10, with continuing reference to FIGS. 6 and 7, the insert 106 additionally includes a disc 128 with a surface 130 that is integrally connected to vanes 132–134 (FIG. 9) at distal ends thereof. Proximal ends of the vanes 132–134 (FIG. 10) are integrally connected to a surface 136 of the disc 112.

The insert 106 is rotatable to cause the vane 132 to move the end 90 in a direction opposite from the direction of the arrow 92, thereby clearing the passageway 72. The purpose of the vanes 133, 134 is to provide structural support for a separation that is maintained between the discs 112, 128.

It should be understood that the range of angles of rotation of the insert 106 that causes the vane 132 to clear the passageway 72 is directly related to the widths of the vane 132 and the end 90. The widths are chosen to cause the passageway 72 to be cleared when the location of the distal portion 54 is within a range substantially defined by the locations 62, 64. As explained hereinafter, the rotation of the discs 112, 128 is caused by a corresponding rotation of the handle 42.

The disc 128 has a central hole 137 therethrough that extends to an intersection of the vanes 132–134 (FIG. 9). Additionally, a hole 138 extends through an intersection of the vanes 132, 133 to an edge of the vane 134. There is substantially a ninety degree angle of intersection between the holes 137, 138.

The transfer tube 108 has an axial hole 140 that is contiguous with the hole 137. The holes 137, 140 have substantially the same diameter.

The protruding section 109 has a discharge hole 142 therein that has an angle of intersection of substantially ninety degrees with the hole 140. The protruding section 109 additionally has a flattened outer surface 144 in the region of the hole 142. Therefore, when the passageway 72 is cleared, water that enters the valve chamber 76 passes through the transfer tube 108 and is discharged therefrom through the discharge hole 142. The path of water through the discharge tube 108 is along a path A—A shown in broken lines (FIGS. 6 and 7). As explained hereinafter the flattened wall 144 is used to couple the tube 108 to the handle 42.

Figure 11:
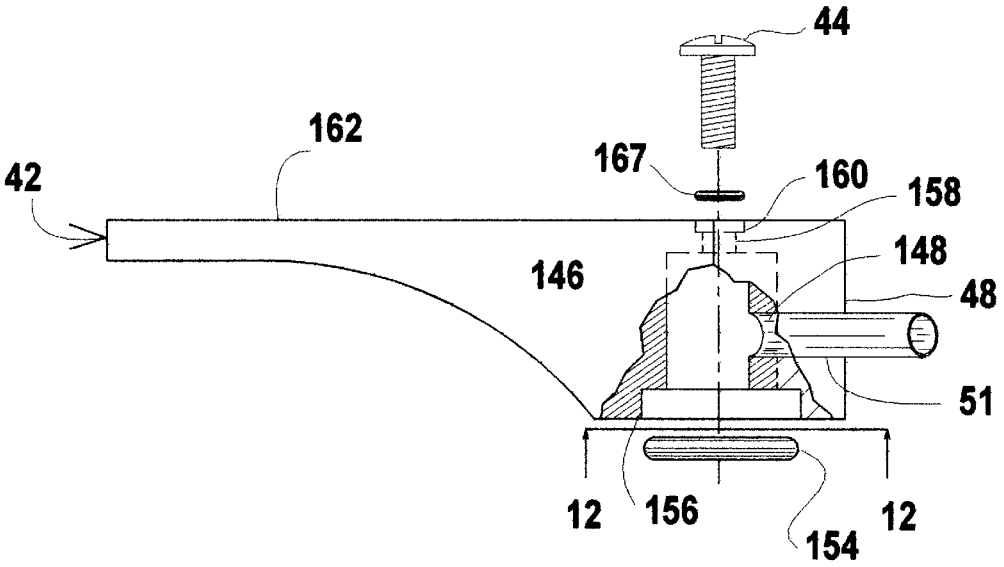
FIG. 11 is a side elevation, with parts broken away, of a handle of the apparatus of FIG. 2.
Figure 12:
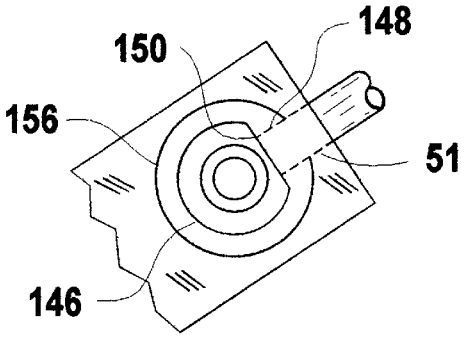
FIG. 12 is a view of FIG. 11 taken along the line 12—12.

As shown in FIGS. 11 and 12, the handle 42 has a generally cylindrical coupling hole 146 therein that has substantially the same diameter as the transfer tube 108 (FIGS. 6 and 7).

An outlet hole 148 extends through the end 48 and has an angle of intersection of substantially ninety degrees with the coupling hole 146. The proximal end 51 is disposed within the hole 148 and is preferably cemented therein whereby the tube 50 extends from the end 48 as described hereinbefore.

The coupling hole 146 has a flattened surface 150 in the region of the intersection with the hole 148. In this embodiment, the shape of the coupling hole 146 is complimentary to the shape of the protruding section 109.

The protruding section 109 is disposed within the coupling hole 146 with the flattened surfaces 144, 150 in an abutting relationship. The complimentary shapes prevent a rotation of the handle 42 relative to the transfer tube 108. In other words, when the handle 42 is rotated, the insert 106 is rotated. Hence, the handle 42 is rotatable to cause either the occlusion or the clearing of the passageway 72. Moreover, the occlusion occurs when handle 42 is rotated to cause the tube 50 to be in the rest position.

The holes 142, 148 are in an alignment that is maintained by the complimentary shapes. The alignment is essential to providing a desired transfer of water through the transfer tube 108 to the tube 50 through the handle 42.

The spring 118 urges the transfer tube 108 to rotate in a direction that results in the occlusion the passageway 72. Because the relative rotation is prevented, the handle 42 is urged to rotate in a direction that moves the tube 50 to the rest position. Therefore, when the woman releases the handle 42, the tube 50 is rotated to the rest position and no water flows therethrough, whereby the toilet can be used for usual toilet facility activities.

Preferably, an O-ring 152 (FIG. 5) is maintained about the transfer tube 108 to prevent a leakage of water from the valve block 40 between the transfer tube 108 and the hole 94. Similarly, an O-ring 154 (FIG. 11) is preferably retained within a recess 156 within the handle 42 to prevent a leakage of water from the coupling hole 146.

The coupling hole 146 is contiguous with a cylindrical coupling section 158 within the handle 42. The coupling section 158 is contiguous with an O-ring recess 160 that extends through a top surface 162 of the handle 42. Additionally, the hole 140 is contiguous with a threaded hole 164 (FIGS. 6 and 7) that extends through a top 166 of the protruding section 109.

When the protruding section 109 is within the coupling hole 146, the screw 44 is screwed into the hole 164, thereby securely connecting the handle 42 to the transfer tube 108. Additionally, an O-ring 167 is disposed within the recess 160 to prevent a leakage of water from the coupling hole 146. O-rings are well known in the art.

The hose bib 46 is connected at its scalloped end 70 (FIG. 1) to a water heater 168 at an outlet end 170 thereof through a flexible tube 172. An inlet end 174 of the heater 168 is connected through a TEE connector 176 and a flexible tube 178 to a manual control valve 180 at an outlet port 182 thereof whereby water from the port 182 is available to the hose bib 46 via the heater 168.

The heater 168 has a manual control knob 184 that is adjustable to cause water provided at the outlet end 170 to be at a desired temperature. The heater 168 is of a type well known in the art.

Preferably, the heater 168 includes a compartment where medication may be placed for a timed release into the water provided at the outlet end 170 whereby a medicated solution is provided at the outlet end 170. The medicated solution may be desirable when a women who has had an episiotomy uses the apparatus 10. Apparatus for providing the timed release of the medication is well known to those skilled in the art.

The TEE connector 176 is additionally connected to a toilet water tank 186 at an input port 188 whereby water is available within the tank 186 to flush the bowl 18. Toilet water tanks are well known to those skilled in the art.

While the invention has been shown and described with reference to a preferred embodiment, it should be understood by those skilled in the art that changes in form and detail may be made therein without departing from the spirit and scope of the invention.

I claim:

1. Apparatus for cleansing the underside of the torso of a person seated upon the seat of a standard toilet, comprising:

an L shaped frame having a first side that is sandwiched between the rear of the exterior of said bowl and a hinged section of said toilet seat and a second side extending on the exterior of said bowl alone an outer edge thereof;

a water tube that passes over the rim of the bowl of said toilet to the interior of said bowl;

a rotatable handle carried on said second side for rotating said water tube from a rest position to move a distal portion thereof through a multiplicity of desired locations within said bowl, said handle having an outlet hole wherein the proximal end of said water tube is disposed, said distal portion having a plurality of aligned holes that cause liquid discharged therefrom to form a sheet that is directed towards said underside;

means for providing a liquid to a proximal end of said water tube, said means for providing being activated when said water tube is rotated from said rest position and deactivated when said water tube is rotated to said rest position; and means for urging said water tube to said rest position.

2. The apparatus of claim 1 wherein said water tube has a first right angle bend that causes said distal portion to extend below said rim and a second right angle bend that causes said distal portion to extend over water within said bowl.

3. The apparatus of claim 1 wherein said water tube is made from plastic.

4. The apparatus of claim 1 wherein said handle is made from plastic.

5. The apparatus of claim 1 wherein said means for providing comprises:

a source of said liquid;

a valve block carried on said second side, said valve block having a valve chamber therein;

a passageway within said valve block that connects said source to said valve chamber;

a valve stem mostly disposed within said passageway that has an end that extends to the interior of said valve chamber, said valve stem being urged to occlude said passageway by the pressure of said liquid;

a generally cylindrical transfer tube that couples said valve chamber to said handle; and means for moving said valve stem in a direction that clears said passageway when said distal portion is rotated from said rest location.

6. The apparatus of claim 5 wherein said liquid is water, additionally comprising means for making a timed release of medication into said water.

7. The apparatus of claim 5 wherein said valve block is made from plastic.

8. The apparatus of claim 5 wherein said means for moving is comprised of a vane connected to said transfer tube.

9. The apparatus of claim 5 wherein said passageway has a coupling section in the general shape of a funnel, an end of said valve stem having the shape of a right truncated cone being disposed within said coupling section.

10. The apparatus of claim 5 wherein said means for urging comprises;

a capstan that is connected to said transfer tube; and a coil spring that is wound about said capstan, one end of said spring being connected to said capstan and the other end being connected to a wall of said valve chamber.

11. The apparatus of claim 5 wherein said transfer tube has a section that protrudes through a hole in said valve block, said protruding portion having a discharge hole therethrough that intersects an axial hole through said transfer tube and a flattened outer surface in the region of said discharge hole, said protruding portion having a shape that is complimentary to the shape of a coupling hole in said handle wherein said protruding portion is disposed, said handle having outlet hole that extends from an end thereof and intersects said coupling hole where said outlet and discharge holes are in alignment.

12. The apparatus of claim 11 additionally comprising means for preventing a leakage of liquid from said valve block between said transfer tube and said hole in said valve block.

13. The apparatus of claim 12 wherein said means for preventing is an O-ring maintained about said transfer tube.

14. The apparatus of claim 5 additionally comprising a hose bib that is screwed into a threaded section of said passageway, a scalloped end of said hose bib being connected to said source.

15. The apparatus of claim 5 additionally comprising means for heating said liquid.

* * * * *